US005810432A

United States Patent [19]

Haut et al.

[11] Patent Number: 5,810,432

[45] Date of Patent: Sep. 22, 1998

[54] HIGH CHAIR SYSTEM

[75] Inventors: Robert E. Haut, Paoli; Glenn E. Gehr, East Earl, both of Pa.

[73] Assignee: Graco Children's Products Inc., Elverson, Pa.

[21] Appl. No.: 556,060

[22] Filed: Nov. 9, 1995

[51] Int. Cl.[6] ..... A47B 83/02

[52] U.S. Cl. ..... 297/153; 297/327; 297/467

[58] Field of Search ..... 297/153, 151, 297/487, 467, 327, 55, 56

[56] References Cited

U.S. PATENT DOCUMENTS

| | | | |
|---|---|---|---|
| D. 131,679 | 3/1942 | Greenbaum . | |
| D. 152,383 | 1/1949 | Waaranan | D15/8 |
| D. 344,189 | 2/1994 | Golenz et al. | D6/339 |
| 1,178,894 | 4/1916 | Wilcox . | |
| 1,428,916 | 9/1922 | Snideman . | |
| 2,019,005 | 10/1935 | Erickson . | |
| 2,131,722 | 10/1938 | Arthur . | |
| 3,383,134 | 5/1968 | Webb et al. | 297/153 |
| 3,475,052 | 10/1969 | Kaposi | 297/153 |
| 3,516,709 | 6/1970 | Nader | 297/153 |
| 4,105,247 | 8/1978 | Saint | 297/149 |
| 4,512,607 | 4/1985 | Rapp | 297/153 |
| 4,650,246 | 3/1987 | Henriksen | 297/467 X |
| 4,807,928 | 2/1989 | Cone | 297/153 |
| 4,818,016 | 4/1989 | Mariol et al. | 297/174 |
| 4,819,988 | 4/1989 | Hellstrom | 297/467 |
| 4,842,331 | 6/1989 | Waples | 297/149 |
| 4,844,537 | 7/1989 | Reed | 297/174 |
| 4,968,092 | 11/1990 | Giambrone | 297/151 |
| 5,106,156 | 4/1992 | Marquis | 297/153 |
| 5,118,161 | 6/1992 | Slowe et al. | 297/153 |
| 5,131,715 | 7/1992 | Balles | 297/5 |
| 5,165,755 | 11/1992 | Rho | 297/56 X |
| 5,183,311 | 2/1993 | Meeker et al. | 297/151 |
| 5,238,292 | 8/1993 | Golanz et al. | 297/153 |
| 5,334,099 | 8/1994 | Marra et al. | 297/467 X |
| 5,364,137 | 11/1994 | Shimer | 297/327 |
| 5,458,394 | 10/1995 | Nichols et al. | 297/153 |
| 5,468,043 | 11/1995 | Chien | 297/153 |
| 5,489,138 | 2/1996 | Mariol et al. | 297/153 X |
| 5,507,550 | 4/1996 | Maloney | 297/327 X |
| 5,509,719 | 4/1996 | Cone, II | 297/327 X |
| 5,527,090 | 6/1996 | Cone, II | 297/153 X |
| 5,527,096 | 6/1996 | Shimer | 297/327 |

OTHER PUBLICATIONS

Best Catalog, 1994/1995, p. 477.

*Primary Examiner*—Peter M. Cuomo
*Assistant Examiner*—Rodney B. White
*Attorney, Agent, or Firm*—Richard B. O'Planick

[57] ABSTRACT

An improved high chair system includes a leg structure, a child seat, and a lower and an upper tray. The child seat may be reclined, and includes a pair of sloping arm rests which allow the child to be placed close to the dining table and allow easy access to the child. The lower tray may be removably mounted on the sloping arm rests, and the upper tray may be mounted on the lower tray. The upper tray includes a tray area which is larger than that of the lower tray. Advantageous mounting structures for the upper and lower trays are disclosed.

17 Claims, 4 Drawing Sheets

HIGH CHAIR SYSTEM

BACKGROUND OF THE INVENTION

1. Field of the Invention

The present invention relates to an improved high chair system for a child, and more particularly, to a reclinable high chair system with sloping armrests and with one or more trays.

2. Description of the Related Art

Conventional high chairs for children typically employ arm rests that are affixed to the side of the chair and assist in the support of the high chair's tray. The high chair tray is typically equipped with a conventional gripping device to attach the tray to the chair. This tray gripping device is structured so that it can grasp the arm rests mounted on the high chair. Thus, although the tray of the typical high chair is removable, the arm rests remain affixed to the chair, and can constitute an obstruction during certain uses and a general inconvenience. During feeding, for example, the conventional arm rests often prevent the conventional high chair from being placed conveniently close to the dinner table, and also are an obstruction and prevent easy access to the child.

Furthermore, conventional high chairs suffer from the drawback of providing only a single tray and fail to provide a flexible multi-tray system which can be adapted for multiple uses and which can be placed in multiple configurations.

SUMMARY OF THE INVENTION

An object of the present invention is to provide a flexible high chair system which can be used in multiple configurations including various reclining positions and which can be used with a plurality of trays. Another object of the present invention is to provide a high chair seat which includes sloping arm rests that overcomes the deficiencies of the prior art. Yet another object is to provide a high chair seat with sloping arm rests which can receive a restraining structure (preferably a lower tray), with the restraining structure being capable of receiving an upper tray.

To achieve these and other advantages and in accordance with the purpose of the invention, as embodied and broadly described, the invention provides for a high chair system for a child adapted for use in multiple configurations comprising a leg structure, a chair seat connected to and supported by the leg structure and including an arm rest portion which includes a mounting structure, a restraining structure including an engagement portion adapted to removably engage with the mounting structure of the arm rest portion, the lower tray further including an edge mounting structure, and an upper tray including a locking structure to removably engage with the edge mounting structure of the lower tray.

In another aspect, the invention provides for an improved high chair seat for allowing easy access to a child, the seat comprising a back rest portion to support the back of the child, a seat portion substantially perpendicular to the back rest portion, and a pair of arm rest portions which slope from an intermediate point of the back rest portion generally toward a front point of the seat portion.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate one embodiment of the invention and together with the written description serve to explain the principles of the invention. In the drawings.

DETAILED DESCRIPTION OF THE PREFERRED EMBODIMENTS

Reference will now be made in detail to the present preferred embodiment of the invention, an example of which is illustrated in the accompanying drawings.

Figure 1:
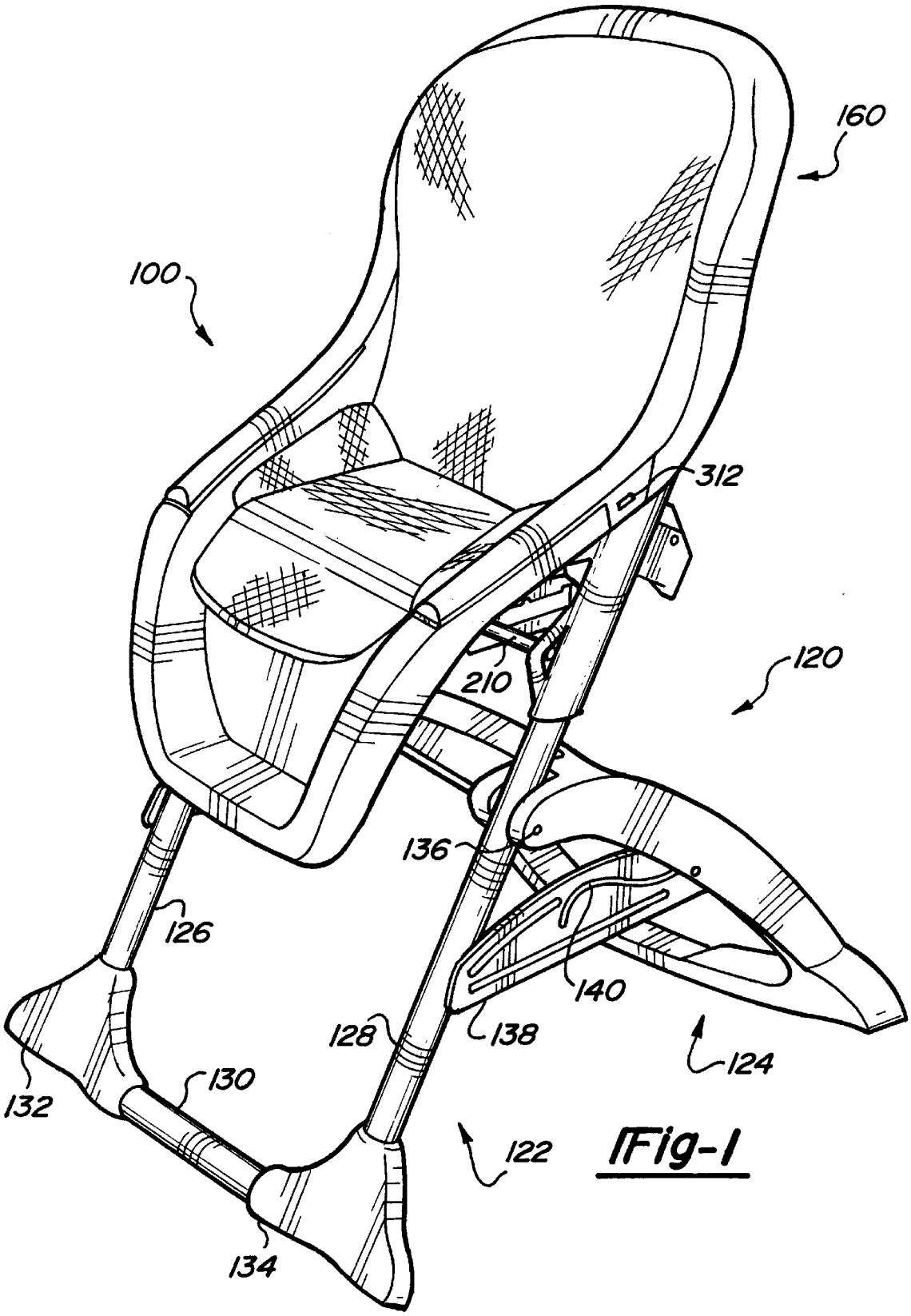
FIG. 1 is a perspective view of a high chair according to the present invention.

FIG. 1 shows a high chair 100 which includes a foldable leg structure 120 and a high chair seat 160. The foldable leg structure 120 generally includes a front leg section 122 and a rear leg section 124. The front leg section preferably includes a U-shaped tube comprising two vertical members 126 and 128 and a lower horizontal member 130 with feet 132 and 134 provided at the corners. The rear leg section 124 is connected to the front leg section 122 at a pivot point 136 to allow the rear legs to fold forward. A folding guide 138 is attached to the rear leg section 124 with a slidable connection and is connected to the front leg section 122 with a pivoting connection. When the lower legs are folded, a sliding portion 139 on the rear leg section 124 slides through channel 140 to facilitate the folding of the rear leg section 124 to the closed position. The folding guide 138 is more clearly shown in FIG. 2.

Figure 2:
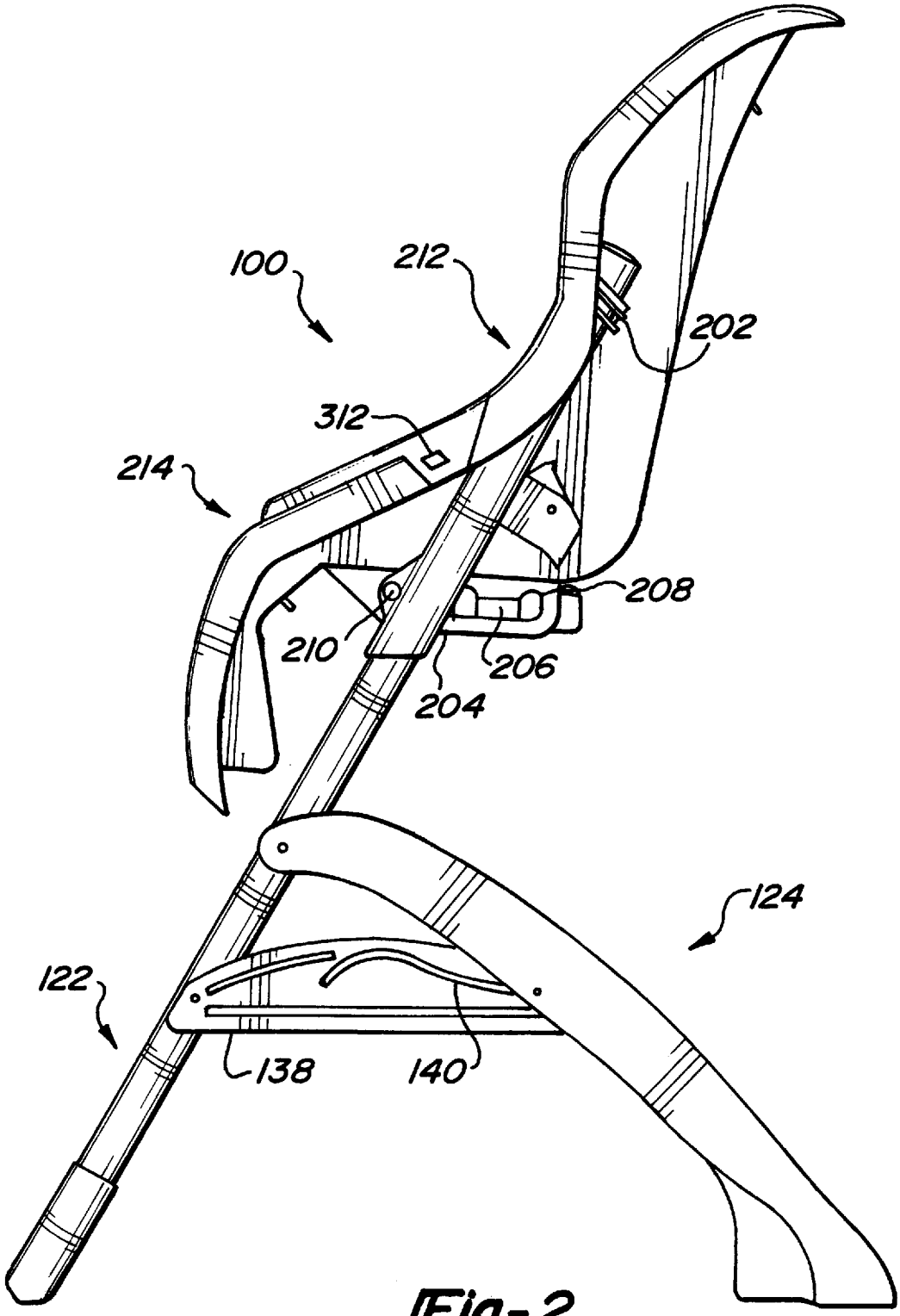
FIG. 2 is a side view of a high chair according to the present invention.

FIG. 2 is a side view of the high chair system 100. As can be seen, the upper portion of the front leg section 122 includes an extension portion 200 with a chair pivot rib 202 attached thereto. The chair pivot is achieved by having the tubes 126 and 128 pass through the chair pivot rib 202 extending from the rear of the high chair seat 160. The chair pivot rib is generally circular and allows tube 128 to pivot therein. The high chair seat 160 pivots within the chair pivot rib 202 to adjust between a sitting up position or a reclining position. Attached to the bottom of the high chair seat 160 is a guide member 204 to adjust the reclining position of the high chair seat 160. The guide member 204 includes a slot 206 with several stops 208. The guide bar 210 is disposed within the slot 206 and engages the stops 208 at various reclining positions. FIGS. 1 and 2 shows the high chair seat in a fully upright position. In the preferred embodiment, three stops 208 are provided in the guide member 204 to facilitate an upright, semi-reclined, and fully reclined configuration.

Figure 3:
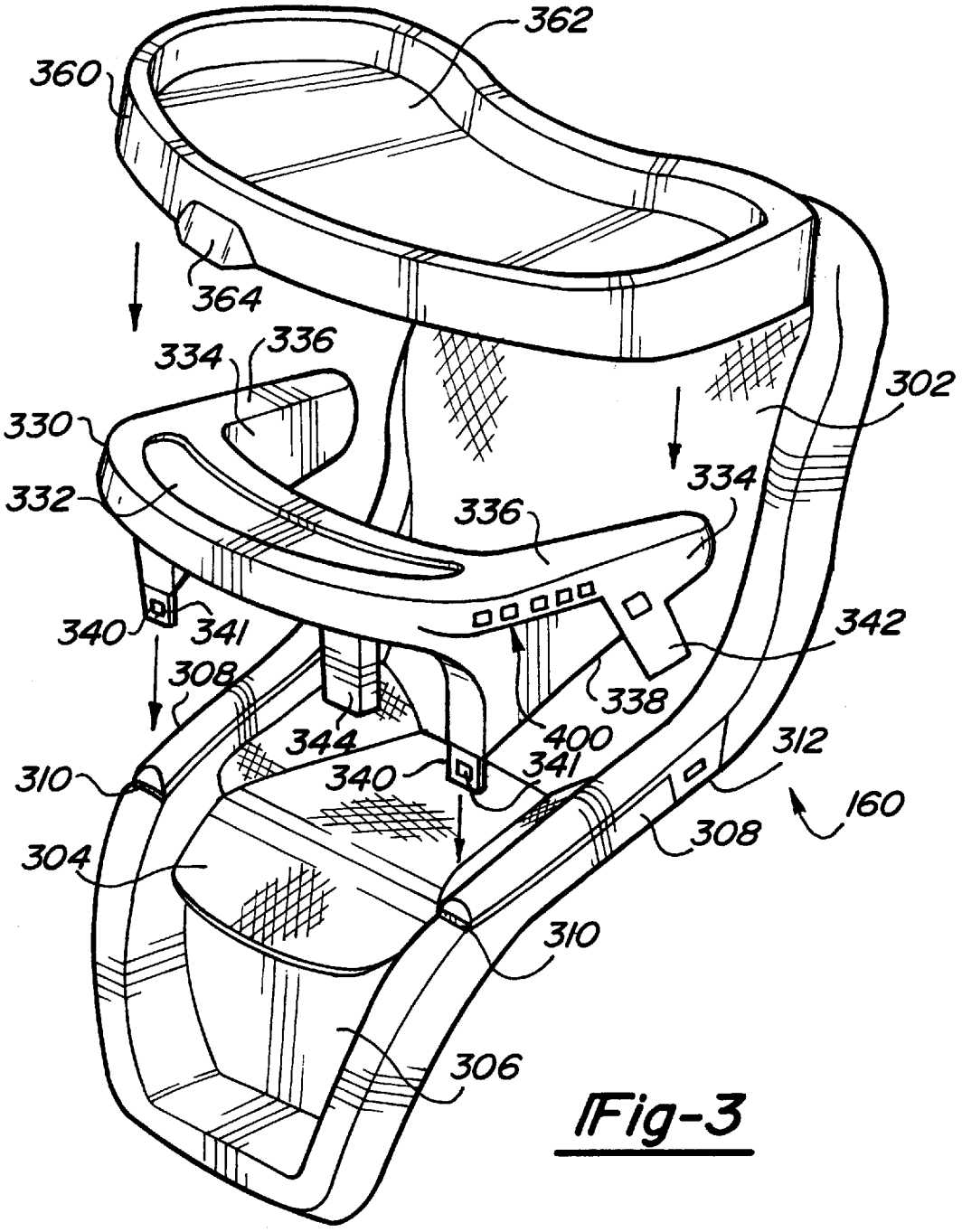
FIG. 3 is an exploded view of a chair seat, lower tray, and upper tray according to the present invention.

FIG. 3 shows the high chair seat 160 in more detail and includes a restraining structure and an upper tray 360. It should be understood that the restraining structure in addition to a restraint belt (not shown) generally functions to restrain the child and prevent slipping or falling out of the chair seat. The preferred embodiment includes a lower tray 330 which surrounds the child and includes a vertical member extending between the legs of the child. The high chair seat 160 generally includes a back rest portion 302, a seat portion 304, and a leg rest portion 306. Preferably, a cushion 307 is provided adjacent to the backrest portion 302 and the seat portion 304. A pair of arm rest portions 308 are shown on either side of the seat portion 304. The back rest portion 302 supports the back of the child. The seat portion 304 is substantially perpendicular to the back rest portion 302, and generally supports the weight of the child. The leg rest portion is substantially perpendicular to the seat portion 304. In the preferred embodiment, the arm rest portions 308 are integral with and connected to the back rest portion 302, the seat portion 304, and the leg rest portion 306.

The arm rest portions 308 are connected to the back rest portion 302 at an intermediate point of the back rest portion 302 and generally slope toward the front of the seat portion 304. The intermediate point of the back rest portion 302 is generally indicated by arrow 212 in FIG. 2 and the front of the seat portion 304 is generally indicated by arrow 214 in FIG. 2. A preferred slope is shown in FIG. 2.

As can be seen, the arm rest portions 308 and the reclining features described above provide several advantages. For example, the arm rest portions 308 allow the chair seat 160 to be positioned closely to a table. The sloping aspect of the arm rest portions 308 advantageously allows for tables of varying heights to be accommodated. Furthermore, the arm rest portions 308 provide for easy access to the child because the sides of the child may be reached directly. Dropped food or toys can be easily retrieved by a caregiver. Also, in a reclined position, the chair seat 160 is particularly useful for infants as they may be unable to sit up straight, and the arm rests 308 provide easy access, for example, during feedings.

Each of the arm rest portions 308 further includes a mounting structure adapted to receive a restraining structure, such as a lower tray 330. In particular, the preferred embodiment includes a receiving orifice 310 (most preferably a slot) on each of the arm rest portions 308 and a tab 312 on the arm rest portion 308 as a mounting structure to receive the lower tray 330.

It should be understood that the restraining structure (and the restraint belt) generally functions to restrain the child and prevent slipping or falling out of the chair seat. The preferred embodiment includes a lower tray 330 which surrounds the child and includes a vertical member 344 extending between the legs of the child to prevent the child from slipping through and underneath the lower tray 330. The lower tray 330 generally includes a tray area 332 which may be used for the storage of small food items or toys. The lower tray 330 also includes two arm rest extensions 334. The arm rest extensions 334 include a smooth upper surface 336 for use as arm rests, and a sloping lower surface 338 at an appropriate slope to engage with the arm rest portions 308. Of course, a child safety belt (not shown) is also preferably included to prevent the child from slipping or falling out of the chair seat. It should be understood that the tray area 332 is preferred, but not required for various embodiments of the present invention. For example, the lower tray 330 could simply provide a safety bar and vertical member to secure the child within the high chair in some embodiments.

In the preferred embodiment, the restraining structure includes an engagement portion, preferably including a lower engagement portion and an upper engagement portion that connect with the mounting structure of the arm rest portions 308 to secure the restraining structure to the chair seat. In particular, the preferred embodiment includes a pair of tabs 340 as the lower engagement portion, and a flexible locking arm 342 as the upper engagement portion. To connect the restraining structure to the chair seat, the tabs 340 are inserted into the receiving orifice 310, and the flexible locking arm 342 is forced downward over the tab 312 to extend over the tab to secure the flexible locking arm 342 to the tab. A locking hole in the flexible locking arm 342 catches onto the tab 312 to lock the arm 342 and the lower tray to the chair seat 166. The insertion of tabs 340 into the receiving orifice 310 further secures the lower tray 330 to the chair seat. Preferably, tabs 340 each include a hole 341 which receives an extending member (not shown) inside the receiving orifice 310 to lock the tabs 340 in place as the lower tray 330 is rotated into place. To remove the lower tray 330, the flexible locking arms 342 are simply pulled outward to disengage the locking hole from the tab 312, and the lower tray is lifted off the chair.

FIG. 3 also shows an upper tray 360 which is adapted to be mounted on the restraining structure. The upper tray includes a tray area 362 which is larger than the tray area 332 of the lower tray 330. The larger tray area 362 provides a more convenient surface for use during feeding of the child. The upper tray 360 includes a release button 364 located on the front portion of the upper tray. As explained with regard to FIGS. 4 and 5, the upper tray may be removed from the lower tray by pressing release button 364 or by pulling on a pair of locking members 502.

Figure 4:
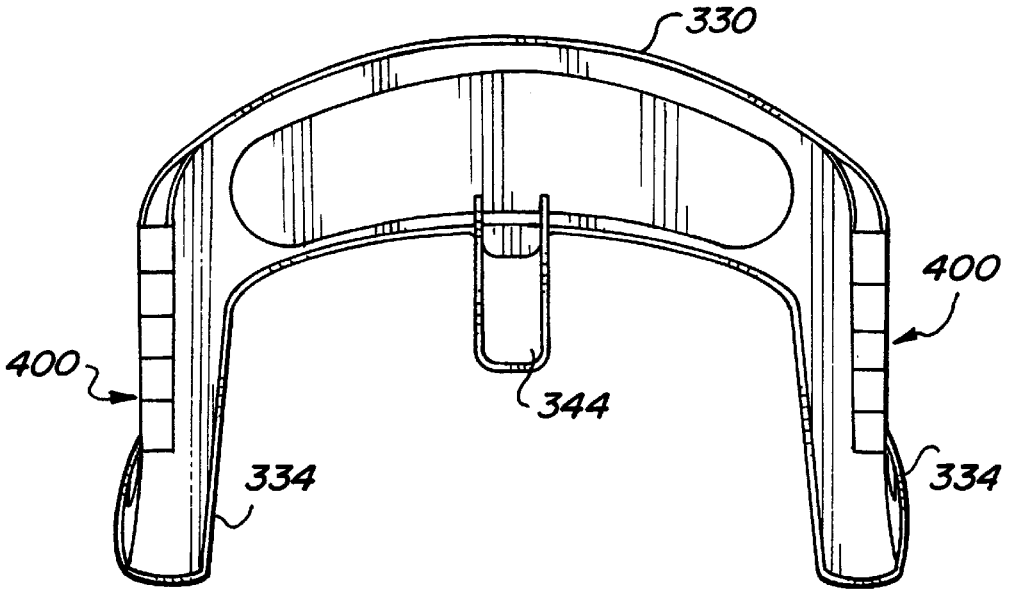
FIG. 4 is a plan bottom view of the lower tray according to the present invention.

FIG. 4 shows the bottom view of the lower tray 330, and in particular shows an edge mounting structure 400. FIG. 3 shows the preferred location of the edge mounting structure 400 underneath a protruding portion of the top surface of the arm rest extensions. In the preferred embodiment, the edge mounting structure includes a plurality of indentations underneath the protruding portion of the arm rest extensions 334. Each of the indentations is intended to receive and cooperate with a locking structure located on the upper tray 360 to thereby secure the upper tray to the lower tray.

Figure 5:
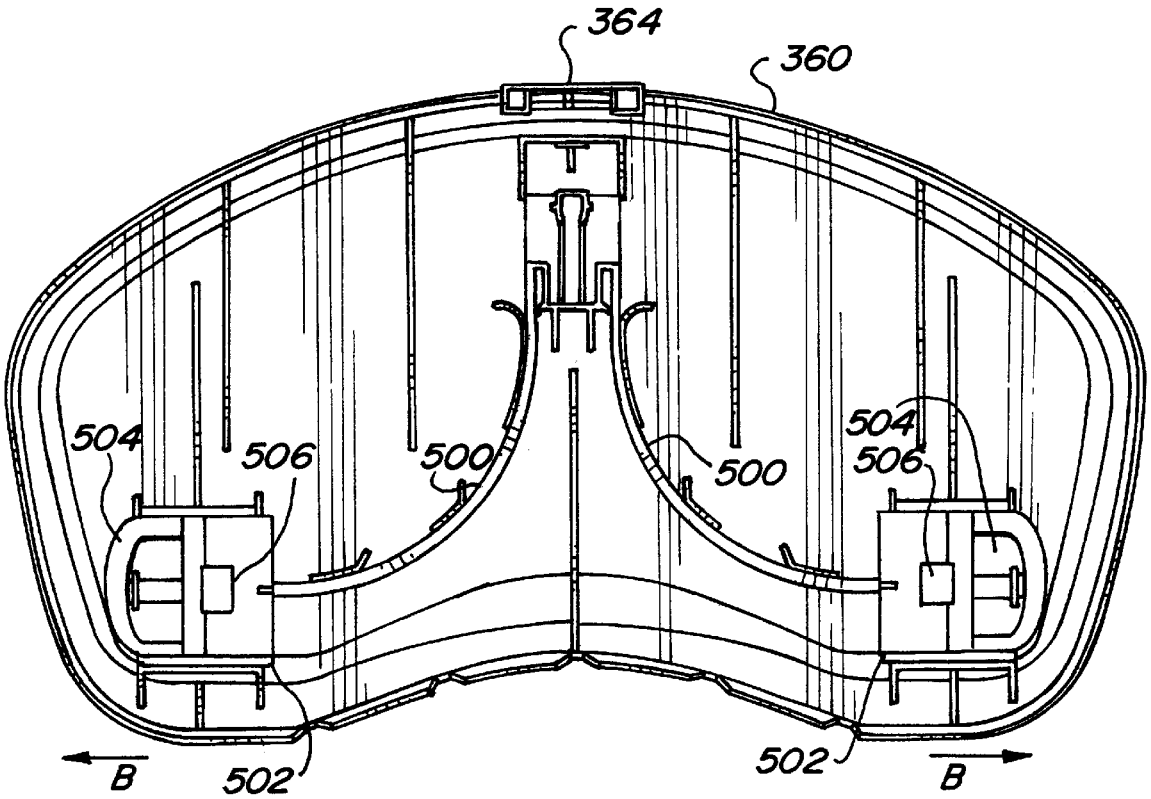
FIG. 5 is a plan bottom view of the upper tray according to the present invention.

A bottom view of the upper tray 360 is shown in FIG. 5. In particular, the release button 364 is shown connected to a pair of connection straps 500. The connection straps 500 are preferably of a flexible but rigid plastic material and are used to transmit force from the release button 364 to a locking structure which preferably comprises a pair of locking members 502. The locking members 502 cooperate and engage with the edge mounting structure 400 on the bottom of the arm rest extensions 334 on the lower tray 330 to secure the upper tray 360 to the lower tray 330.

The locking members 502 preferably include a handrelease section 504 and a locking tab structure 506. The locking member 502 is connected to the upper tray 360 to allow the locking member 502 to slide outward and is spring loaded in a locked position (shown in FIG. 5) to engage the edge mounting structure 400. Preferably, a spring (not shown) is mounted internal to the release button 364 to bias the button outwardly toward the edge of the upper tray 360 and the locking members 502 inward toward the center of the upper tray 360. Accordingly, a tension is created in the connection straps 500 to bias the locking member 502 into a locked position.

To install the upper tray 360 onto the lower tray 330, the upper tray is generally positioned over the lower tray, and then lowered until the locking tabs structure 506 engages the edge of the protruding portion of the arm rest extensions 334 of the lower tray. By further lowering the upper tray 360, the locking member is caused to slide in the direction shown by arrow B and the locking tab structure 506 is forced down over the protruding portion. The locking tab structure 506 then snaps into the edge mounting structure 400. As can be seen in FIG. 4, the preferred embodiment includes five indentations which may be engaged by the locking tab structure 506 to provide for a variety of positions of the upper tray 360.

To remove the upper tray 360, the hand-release section 504 may be pulled by reaching along the sides of the upper tray to slide the locking member 502 in the direction shown by arrow B. Similarly, depressing the release button 364 creates a compression force in the connection straps 500 and causes a similar sliding of the locking members 502. Accordingly, the locking tab structure 506 is disengaged from the edge mounting structure 400 to unlock the upper tray 360 which may then be lifted off the lower tray 330.

It will be apparent to those skilled in the art that various modifications and variations can be made in the bracket of the present invention without departing from the spirit or scope of the invention. Thus, it is intended that the present invention cover the modifications and variations of this invention provided they come within the scope of the appended claims and their equivalents.

What is claimed is:

1. A high chair system for a child adapted for use in multiple configurations comprising:

a leg structure;

a chair seat connected to and supported by the leg structure and including an arm rest portion which includes a mounting structure integrally formed in the arm rest portion;

a detachably connected restraining structure including an integrally formed locking portion configured to detachably lock the restraining structure to the mounting structure of the arm rest portion, the detachably connected restraining structure further including an edge mounting structure; and an upper tray including a locking structure to removably engage with the edge mounting structure of the restraining structure.

2. The high chair system of claim 1, wherein the leg structure includes a foldable leg structure comprising a front leg section and a rear leg section.

3. The high chair system of claim 1, wherein the leg structure and the chair seat are connected by a pivotable connection to allow the chair seat to recline.

4. The high chair system of claim 1, wherein the mounting structure of the arm rest portion includes a receiving orifice and a tab for securing the integrally formed locking portion to the arm rest portion.

5. The high chair system of claim 1, wherein the detachably connected restraining structure comprises a lower tray.

6. The high chair system of claim 1, wherein the integrally formed locking portion of the detachably connected restraining structure includes a lower engagement portion and an upper engagement portion removably engaged with the mounting structure.

7. The high chair system of claim 6, wherein the lower engagement portion includes a tab and the upper engagement portion includes a flexible locking arm.

8. The high chair system of claim 1, wherein the edge mounting structure includes a plurality of indentations underneath a protruding portion of the detachably connected restraining structure.

9. The high chair system of claim 1, wherein the locking structure of the upper tray includes a pair of slidably locking members.

10. The high chair system of claim 9, wherein the upper tray further includes a release button connected to the slidably locking members by connecting straps, whereby the upper tray can be removed by depressing the release button or pulling outwardly on the slidably locking members.

11. The high chair system of claim 9, wherein the pair of slidably locking members each includes a locking tab structure.

12. An improved high chair system comprising:

a seat having a back rest portion to support the back of the child, a seat portion substantially perpendicular to the back rest portion, and a pair of arm rest portions which slope from an intermediate point of the back rest portion generally toward a front point of the seat portion, said armrest portions includes a mounting structure;

a detachably connected restraining structure including an integrally formed locking portion configured to detachably lock the restraining structure to the mounting structure; and an upper tray adapted to be mounted on the detachably connected restraining structure, the detachably connected restraining structure including an edge mounting structure, and the upper tray including a locking structure adapted to engage the edge mounting structure to secure the upper tray to the restraining structure.

13. The improved high chair system of claim 12, wherein the mounting structure includes a receiving orifice and a tab for securing the detachably connected restraining structure to the arm rest portion.

14. The improved high chair system of claim 12, wherein the integrally formed locking portion comprises a lower engagement portion and an upper engagement portion connected to the mounting structure to secure the restraining structure to the chair seat.

15. The improved high chair system of claim 14, wherein the lower engagement portion includes a tab and the upper engagement portion includes a flexible locking arm.

16. The improved high chair system of claim 15, wherein the detachably connected restraining structure comprises a lower tray.

17. The improved high chair system of claim 16, wherein the upper tray has a tray area which is larger than a tray area of the lower tray.

* * * * *